US005121557A

United States Patent [19]

Moore

[11] Patent Number: 5,121,557

[45] Date of Patent: Jun. 16, 1992

[54] ARTICULATING ATTACHMENT FOR FRONT LOADERS AND THE LIKE

[76] Inventor: Michael D. Moore, 1213 Darling St., Napa, Calif. 94558

[21] Appl. No.: 779,843

[22] Filed: Oct. 21, 1991

[51] Int. Cl.[5] ..... E02F 3/76

[52] U.S. Cl. ..... 37/117.5; 37/118 A; 37/DIG. 15

[58] Field of Search ..... 37/117.5, DIG. 15, 231, 37/234, 235, 236, 4, 118 A, 141 R

[56] References Cited

U.S. PATENT DOCUMENTS 3,539,022 11/1970 Berg ..... 37/118 A X
3,591,935 7/1971 Bremmer ..... 37/118 A X
4,030,626 6/1977 Durham ..... 37/118 A X
4,810,162 3/1989 Foster ..... 37/118 A X

*Primary Examiner*—Dennis L. Taylor
*Assistant Examiner*—J. Russell McBee

[57] ABSTRACT

An articulating attachment is provided for use in conjunction with tractors, front loaders and the like wherein the attachment facilitates rotary and sliding motion of a working member such as a blade or bucket carried by the tractor or front loader having a mounting plate for connecting the attachment to said loader, a hydraulically driven rotary drive carried by the mounting plate and a hydraulically driven sliding drive carried by the rotary drive. The rotary drive and sliding drive may be operated simultaneously. A clam shell drive is also provided capable of opening and closing a bucket having two opposed jaws.

9 Claims, 8 Drawing Sheets

ARTICULATING ATTACHMENT FOR FRONT LOADERS AND THE LIKE

BACKGROUND OF THE INVENTION

This invention relates in general to an articulating attachment for tractors, front loaders and the like. More particularly, the invention relates to an articulating attachment which may be removably installed on a front loader. The articulating attachment carries a bucket or other working member and allows the bucket or working member to be rotated 360° about a horizontal axis, to be slid in a direction transverse to the direction of travel of the loader and, also, allows the use of a two-piece clam shell bucket wherein the clam shell may be opened and closed.

The prior art includes mechanisms for rotating a blade, including the Arnold U.S. Pat. No. 4,824,319 and the Fezatt et al U.S. Pat. No. 4,126,833. These patents teach mechanisms for rotating the blade (Arnold teaches rotation about a horizontal axis, Fezatt teaches rotation about a vertical axis), but neither teaches a mechanism for sliding the blade horizontally relative to the tractor. Furthermore, neither of those patents teaches a clam shell bucket which may be opened and closed.

The prior art also includes Billings U.S. Pat. No. 4,512,090 which teaches a blade with a scraper and scarifier wherein the second plate may be rotated with respect to the first plate. This feature achieves only partial rotation of the second blade and does not teach the horizontal slidability of the blade relative to the tractor.

The Veys U.S. Pat. No. 4,854,811 teaches the skewing of the blade which achieves a small amount of horizontal sliding, whereas the instant invention achieves considerable horizontal sliding of the blade.

The prior art does teach clam shell operation of a two-piece bucket or blade, as taught by Walters et al U.S. Pat. No. 4,928,410 and the Risch U.S. Pat. No. 4,804,309. The Walters clam shell is much more complicated than the design of the instant invention and Walters does not teach rotation or sliding of the blade along with opening and closing of the clam shell. The clam shell taught by Risch is used in conjunction with a backhoe and similarly does not teach rotation or horizontal sliding of the clam shell relative to the tractor.

The prior art also teaches quick release blades and attachments for tractors and front loaders including the Birk U.S. Pat. No. 3,760,883, the Hohn U.S. Pat. No. 4,846,624 and Eriksson U.S. Pat. No. 4,571,146. These devices do teach a quick release attachment but do not teach a mechanism for rotating and/or sliding the bucket, and do not teach opening and closing of a two-piece clam shell bucket.

SUMMARY OF THE INVENTION

The present invention provides a removable attachment for use in conjunction with, for example, a front loader having a two-piece clam shell bucket. The clam shell bucket is removed from the front of the loader, the articulating attachment of the present invention is attached to the front of the loader, and the two-piece clam shell bucket is attached to the forward end of the articulating attachment of the invention. A control handle is installed in the cab of the loader and the hydraulic drive for the attachment is connected to the hydraulic drive of the loader. The front loader bucket can then be rotated through a full 360° in a direction transverse to the direction of travel of the loader. Also, the bucket can be slid horizontally in a direction transverse to the direction of travel of the loader. Thirdly, the two-piece clam shell bucket can be opened and closed. Each of the three drives for the rotating function, the horizontal sliding function, and the opening and closing of the clam shell is independent of one another.

A primary object of the invention is to provide an articulating attachment for use in conjunction with a front loader or tractor wherein the attachment facilitates rotary and sliding motion of a working member carried by the attachment.

A further object of the invention is to provide a removable attachment for use in conjunction with a front loader or tractor wherein the attachment provides for independent motion of a blade or bucket in a rotary fashion in a direction transverse to the direction of travel of the tractor or loader, for sliding motion in directions transverse to the direction of travel of the loader or tractor and for opening and closing a two-piece clam shell blade or bucket carried by the loader or tractor.

Another object of the invention is to provide an articulating attachment wherein rotary and sliding motion may be imparted simultaneously to a working member such as a blade or bucket.

A further object of the invention is to provide an articulating attachment wherein rotary, transverse sliding and opening and closing of a two-piece clam shell blade may be achieved simultaneously.

Another object of the invention is to provide an articulating attachment which provides rotary, horizontal sliding and opening or closing of a two-piece clam shell blade, all of which motions may be controlled by one hand of the operator.

Other objects and advantages of the invention will become apparent from the following description of the invention and the drawings wherein:

DETAILED DESCRIPTION OF THE DRAWINGS

Figure 1:
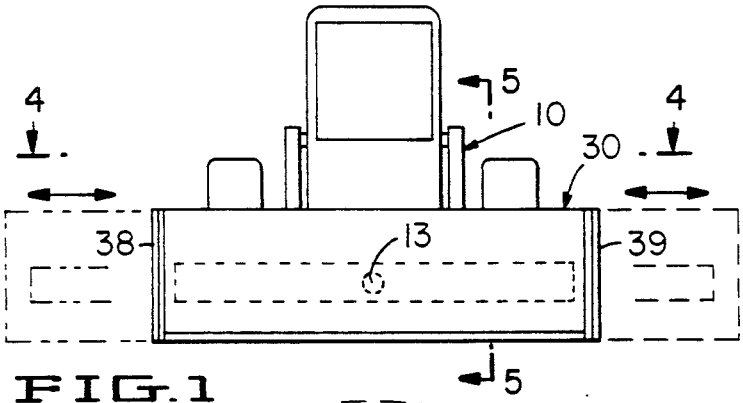
FIG. 1 is a front elevational view of a front loader showing the horizontal sliding motion achieved by use of the invention.
Figure 2:
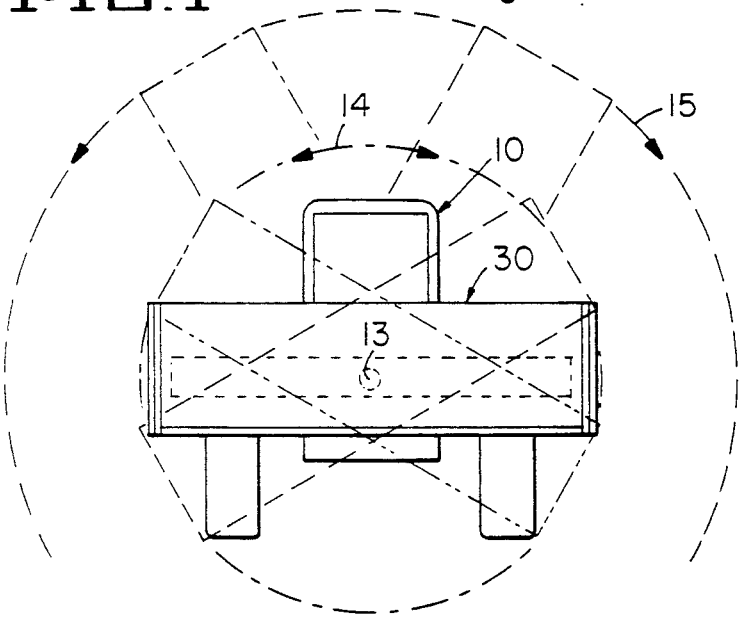
FIG. 2 is a front elevational view of a front loader showing the rotational movement of a bucket which can be achieved by using the attachment of the present invention.
Figure 3:
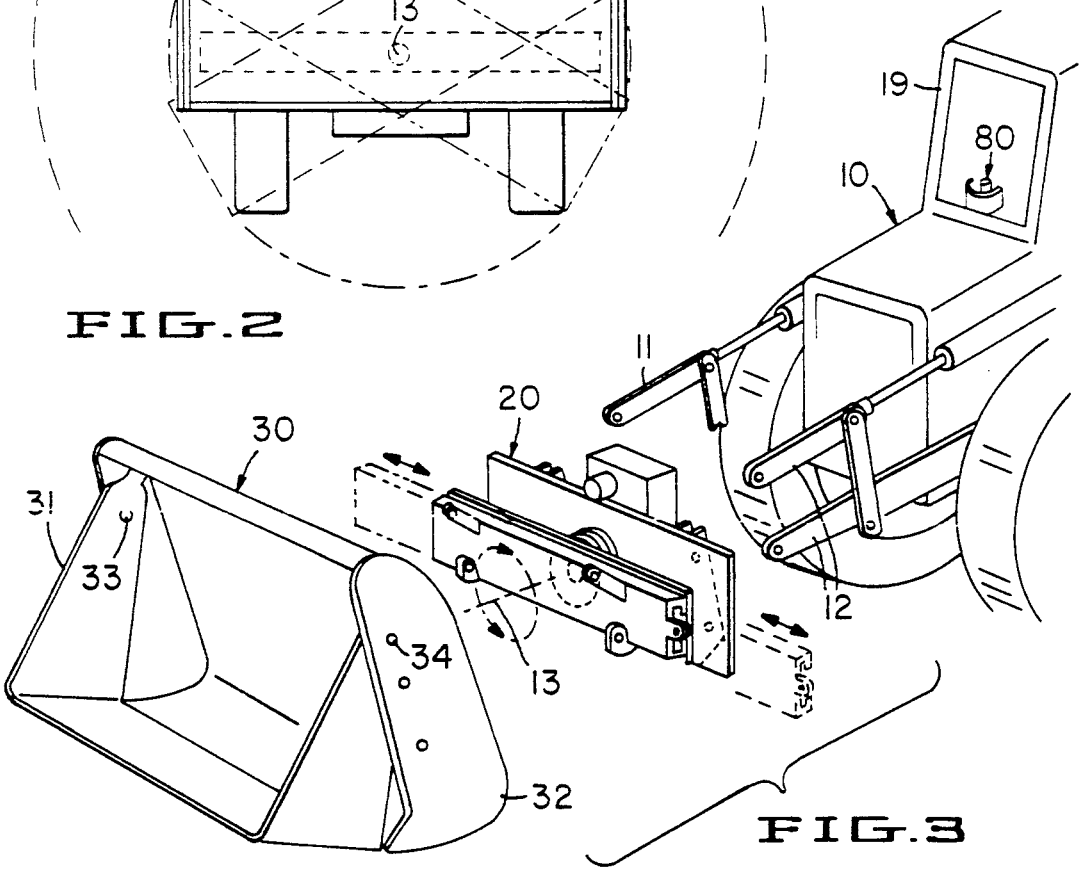
FIG. 3 is a perspective view showing the removable attachment of the present invention about to be installed on a front loader.
Figure 4:
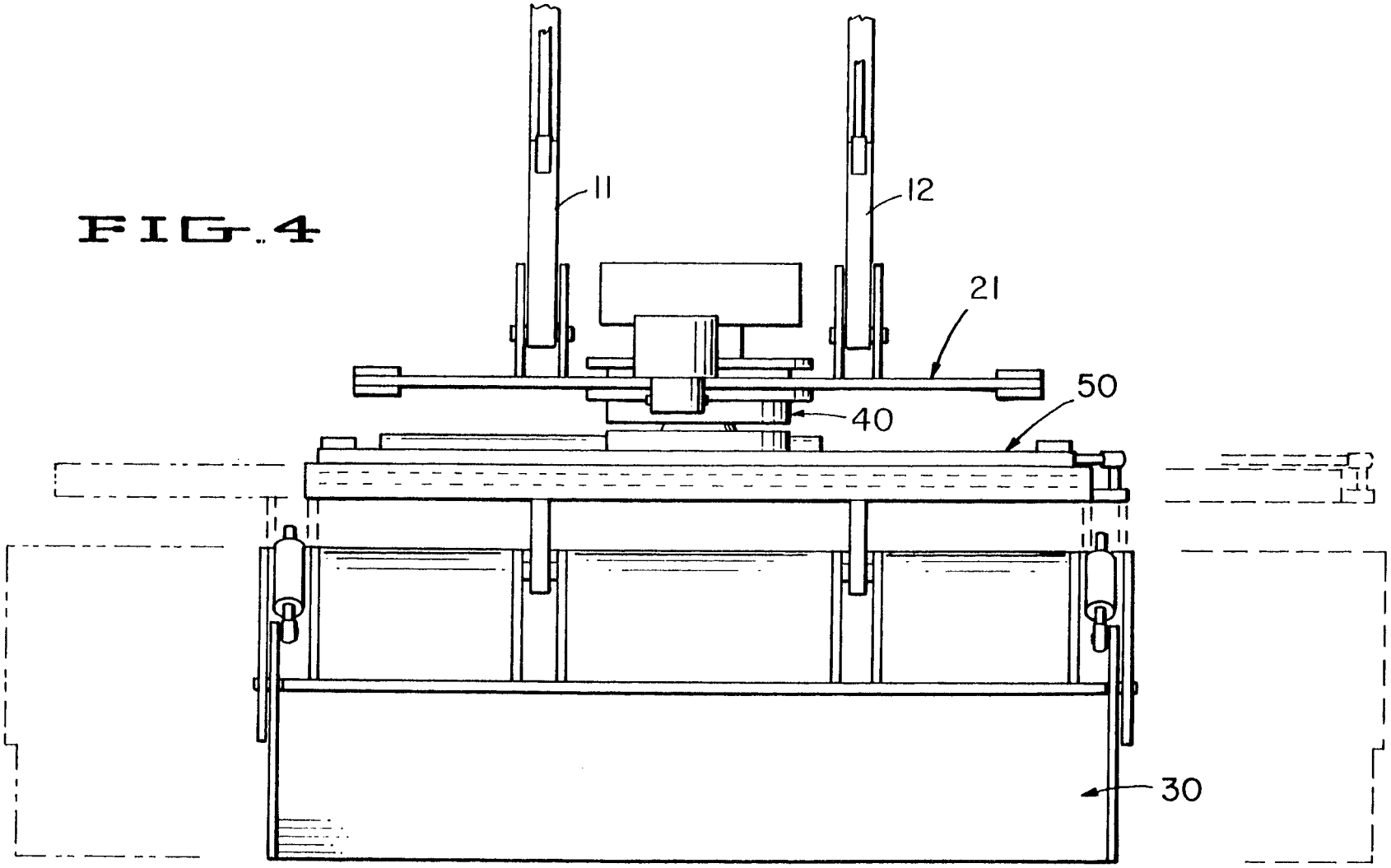
FIG. 4 is a top view on the line 4—4 of FIG. 1.

Referring to FIGS. 1-3, a front loader 10 is shown with a two-piece bucket 30. The articulating attachment of the present invention is shown generally as 20 in FIG. 3. The articulating attachment 20 of the present invention may be applied to the forward mounting forks 11 and 12 of loader 10. The bucket 30 is then carried by articulating attachment 20. When attachment 20 is in place, the bucket 30 may be slid horizontally to the position shown in phantom in FIG. 1. The blade 30 may also be rotated about axis 13, shown best in FIG. 3, through a full 360°. As also shown in FIG. 2, blade 30 may be extended horizontally to either of the positions shown in phantom in FIG. 1 and rotated about a full 360°. The arrows 14 in FIG. 2 show the path of rotation of bucket 30 when the bucket is centered horizontally relative to axis 13. The arrows 15 in FIG. 2 describe the path of the edge of bucket 30 when bucket 30 has been slid to a position shown in phantom in FIG. 1 and also rotated about axis 13.

As shown best in FIG. 3, bucket 30 comprises two jaws 31 and 32 which are pivotally mounted at pivots 33 and 34. As described in greater detail below, this two-piece "clam shell" bucket may be opened and closed as one aspect of this invention.

Figure 6:
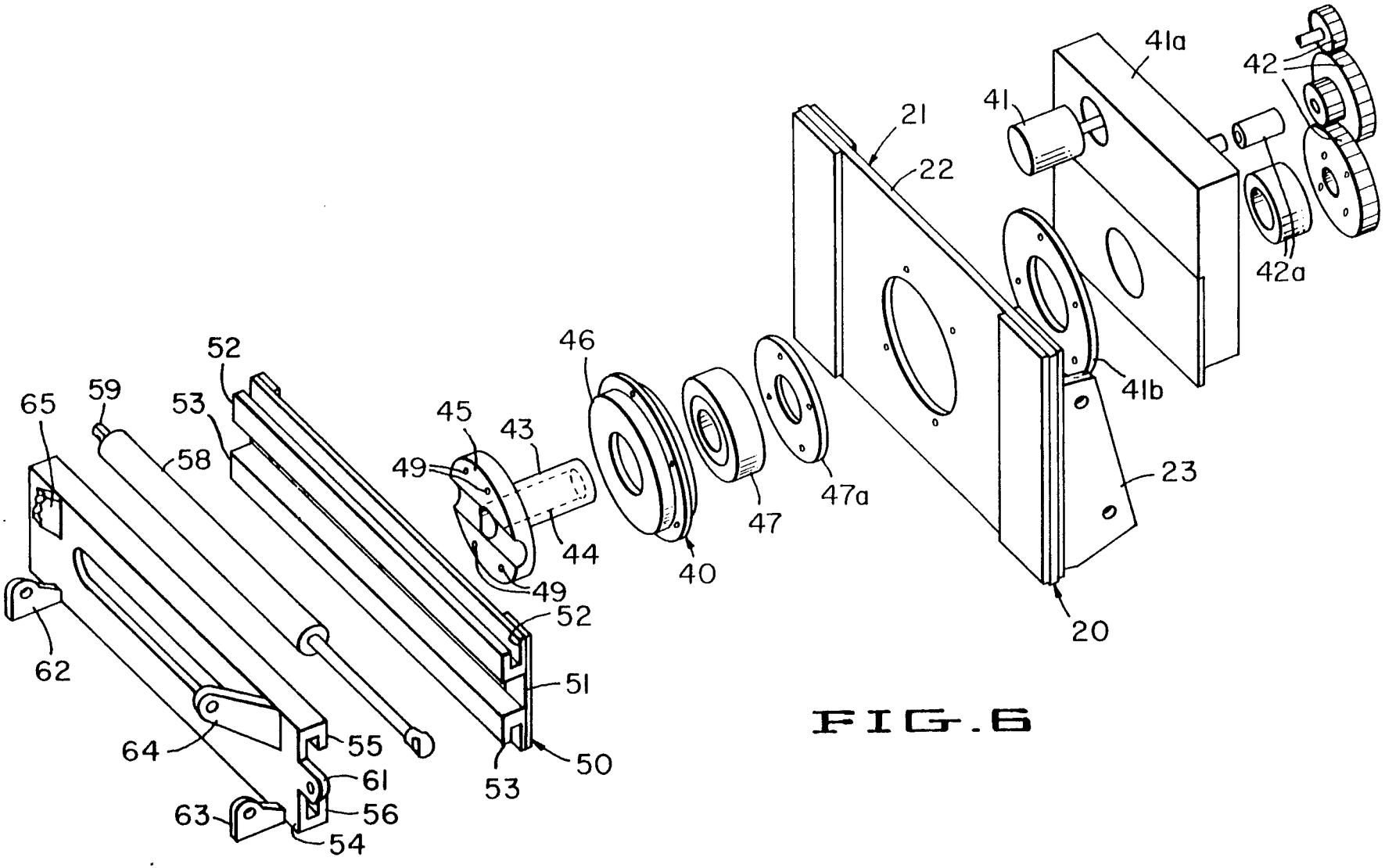
FIG. 6 is a perspective view showing in exploded fashion the components of the rotary drive and horizontal sliding drive aspects of the invention.
Figure 10:
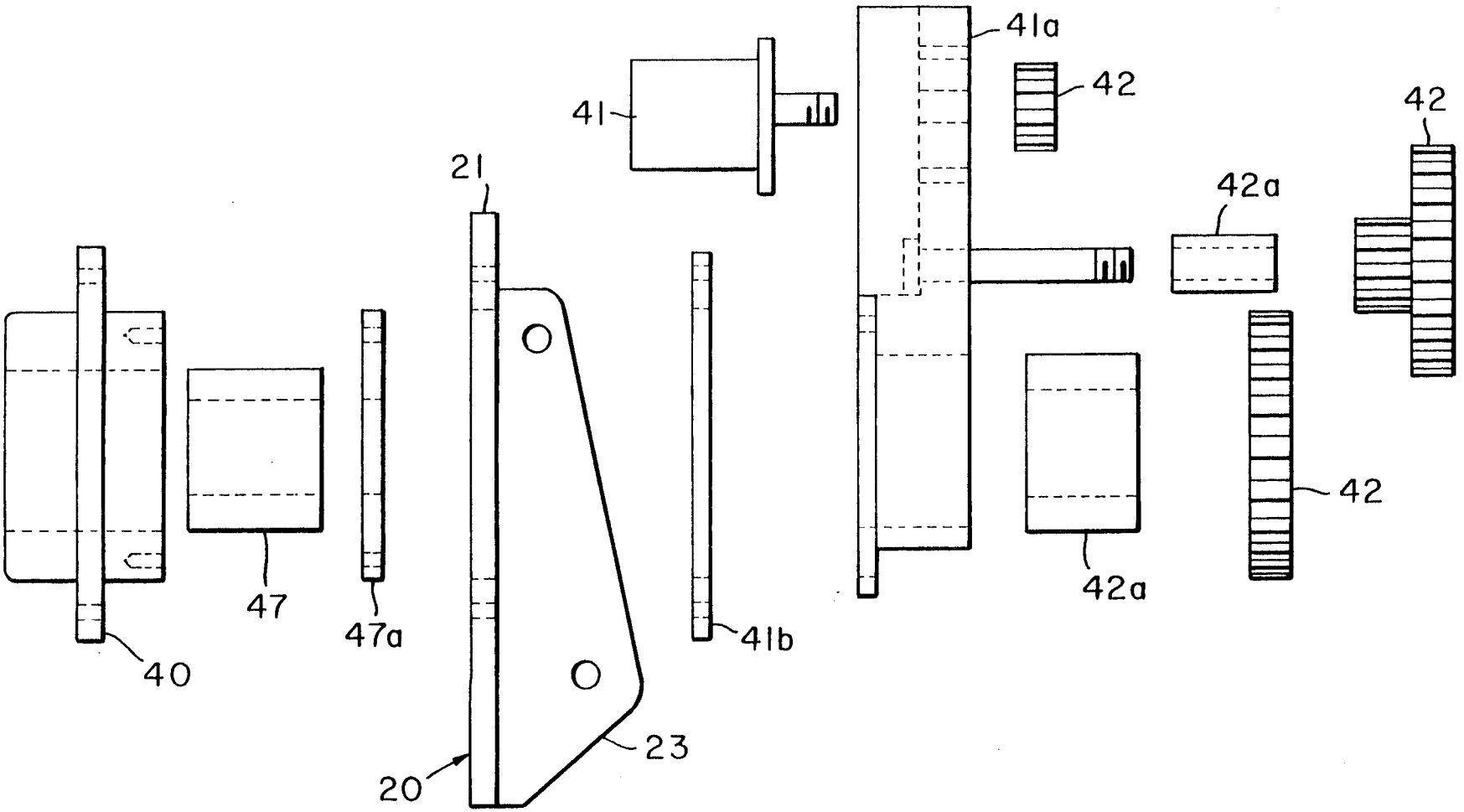
FIG. 10 is a side elevational view showing in exploded fashion some of the components of the drive mechanism shown in FIG. 6.

Referring to FIGS. 6 and 10, the components of the articulating attachment 20 are shown in exploded fashion. A mounting plate means 21 is provided for connecting attachment 20 to the loader 10 or tractor. Mounting plate means 21 comprises a flat steel plate 22 and a pair of mounting ears 23 adapted to engage the forward arms 11 and 12 of loader 10 (FIG. 1).

Rotary drive means is shown generally as 40. Rotary drive means 40 is carried by mounting plate means 21 and imparts rotary motion to the bucket 30 (or other working member) in directions transverse to the direction of travel of loader 10. Rotary drive means 40 includes a hydraulic motor 41 carried by gear case and motor housing 41*a* which is carried by mounting plate means 21. A steel ring 41*b* is used to connect mounting plate 21 to the gear case and motor housing 41*a*. Hydraulic motor 41 is connected through an appropriate gear train 42 carried by bushings 42*a* to a hub 43. Hub 43 has a cylindrically shaped hollow sleeve 44 which carries a circular plate 45 which in turn carries sliding drive means 50. Hub 43 is carried by thrust bearing 46 and a rotational bearing 47, which bearings are in turn carried by mounting plate means 21. A bearing cover 47*a* protects bearing 47. In this fashion, rotary drive means 40 is carried by mounting plate means 21 and hub 43 is free to rotate through more than 360° relative to said mounting plate means.

Sliding drive means 50 shown in FIG. 6 is carried by rotary drive means 40. Sliding drive means 50 includes a first plate 51 rigidly connected to hub 43 by being bolted to circular plate 45 through holes 49. A pair of generally U-shaped elongated channels 52 and 53 are rigidly attached to first plate 51 and extend generally parallel to each other. Second plate 54 has a pair of elongated L-shaped fingers 55 and 56 adapted to slidably engage U-shaped channels 52 and 53 carried by first plate 51. The assembled position of first and second plates 51 and 54 is shown best in FIG. 5.

A double action hydraulic cylinder 58 is connected at one end 59 to first plate 51 and at its other end 60 to tab 61 of second plate 54. Operation of hydraulic cylinder 58 causes relative sliding motion between plates 51 and 54.

The sliding motion achievable by this mechanism is considerable. In the embodiment shown in FIGS. 1-6, the right edge 38 of bucket 30 may be slid past the central, rotational axis 13 of the rotary drive means, and the left edge 39 may be moved an equal distance. The bucket 30 may be slid a distance in either direction which exceeds 50% of the width of bucket 30.

Second plate 54 also carries mounting tabs 62, 63, 64 and 65 for carrying bucket 30.

Figure 5:
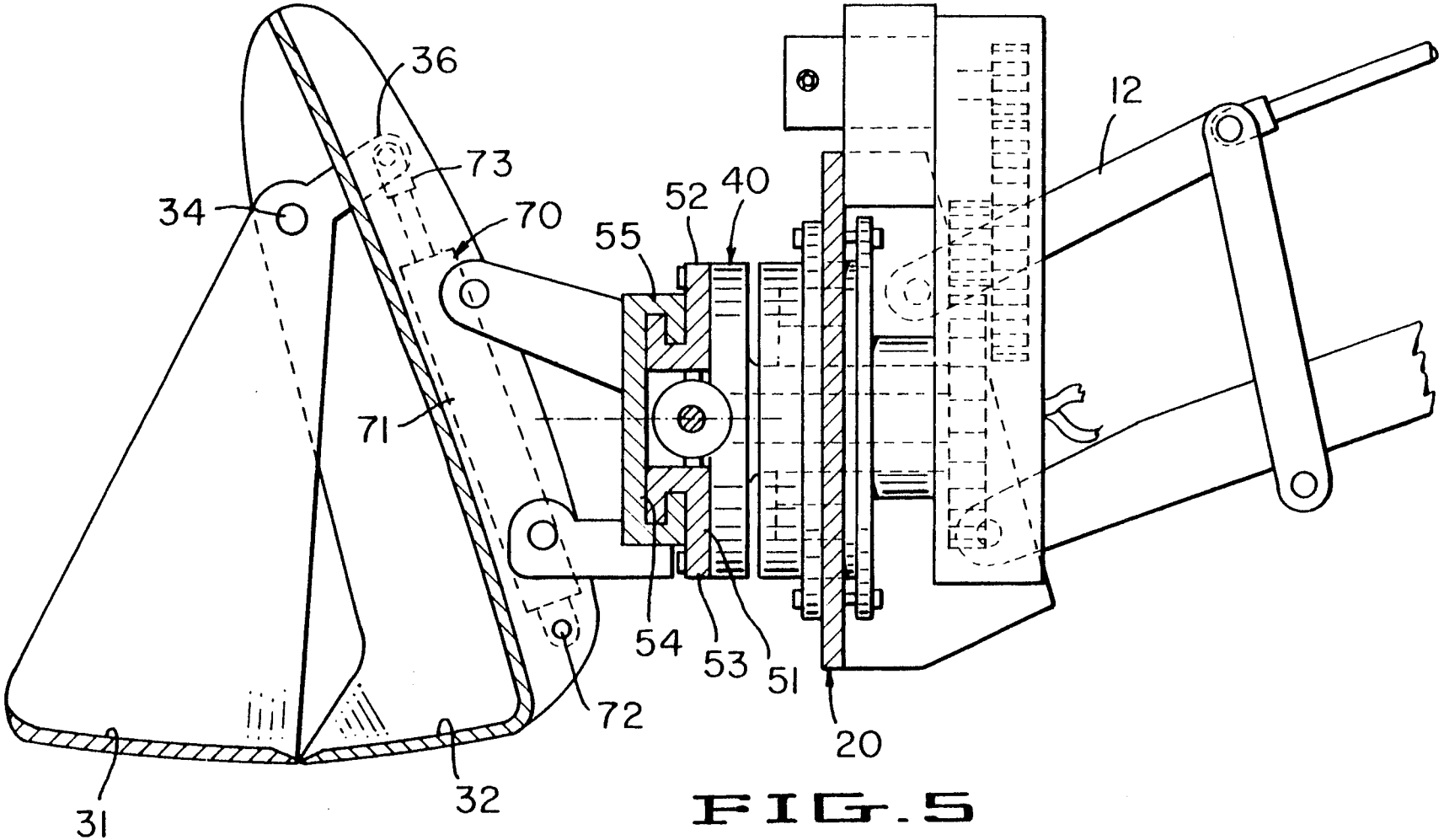
FIG. 5 is a side elevational view partially in section on the line 5—5 of FIG. 1.

As shown best in FIG. 5, the working member carried by articulating attachment 20 of this invention may be, for example, a two-piece "clam shell" bucket as shown in FIG. 5. The working member may also be a single piece bucket or a single piece blade. As shown in FIG. 5, the clam shell bucket has a pair of jaws 31 and 32 pivotally mounted about pivot 34 so that the jaws may open and close. Hydraulic drive means 70 is provided for opening and closing jaws 31 and 32. Hydraulic drive means 70 includes a double acting hydraulic cylinder 71 which is carried at one end 72 by jaw 32 and which is connected at its other end 73 to a protruding ear 36 of jaw 31. Motion of the double acting hydraulic cylinder causes jaws 31 and 32 to open or close.

Figure 9:
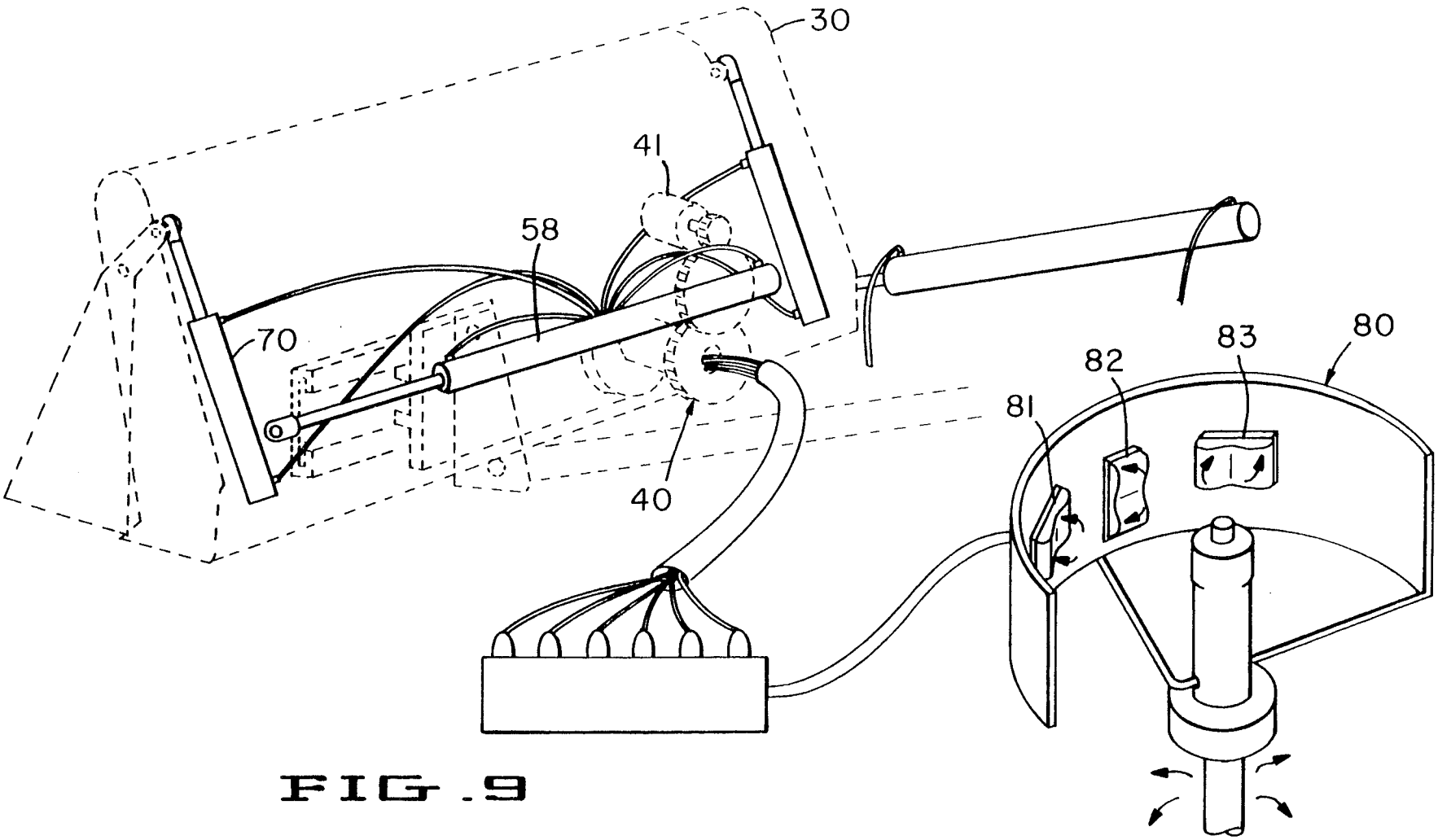
FIG. 9 is a schematic representation showing the hand operated control and the independent drives for the bucket.

As shown best in FIG. 9, control means 80 is provided for operation of the articulating attachment 20 of this invention. Control means 80 is mounted in the cab 19 of loader 10 as shown best in FIG. 3. Control means 80 comprises three switch means 81, 82 and 83 for controlling the rotary drive, the horizontal sliding drive and the opening and closing of a two-piece clam shell bucket. As shown schematically in FIG. 9, switch means 81 controls hydraulic motor 41 which, in turn, controls the rotary drive means 40. Switch means 82 controls the double acting cylinder 58 which causes horizontal sliding of bucket 30. Switch means 83 controls the double acting cylinder 70 which opens and closes the two-piece clam shell bucket 30. As shown in FIG. 9, control means 80 comprises three separate switches mounted sufficiently close together that all may be operated by one hand of the operator.

As shown in FIG. 9, each of the drive mechanisms for the rotary motion, horizontal sliding motion and opening/closing of the clam shell is independent of each other. This independence of the drive means enables the operator to, for example, move the blade horizontally to a selected position and then rotate the blade and thereafter to open and close the clam shell. The drives may also be operated simultaneously, whereby the operator can activate switch means 81 and 82 to cause the simultaneous horizontal sliding of the blade as well as rotary motion of the blade or bucket.

Figure 8:
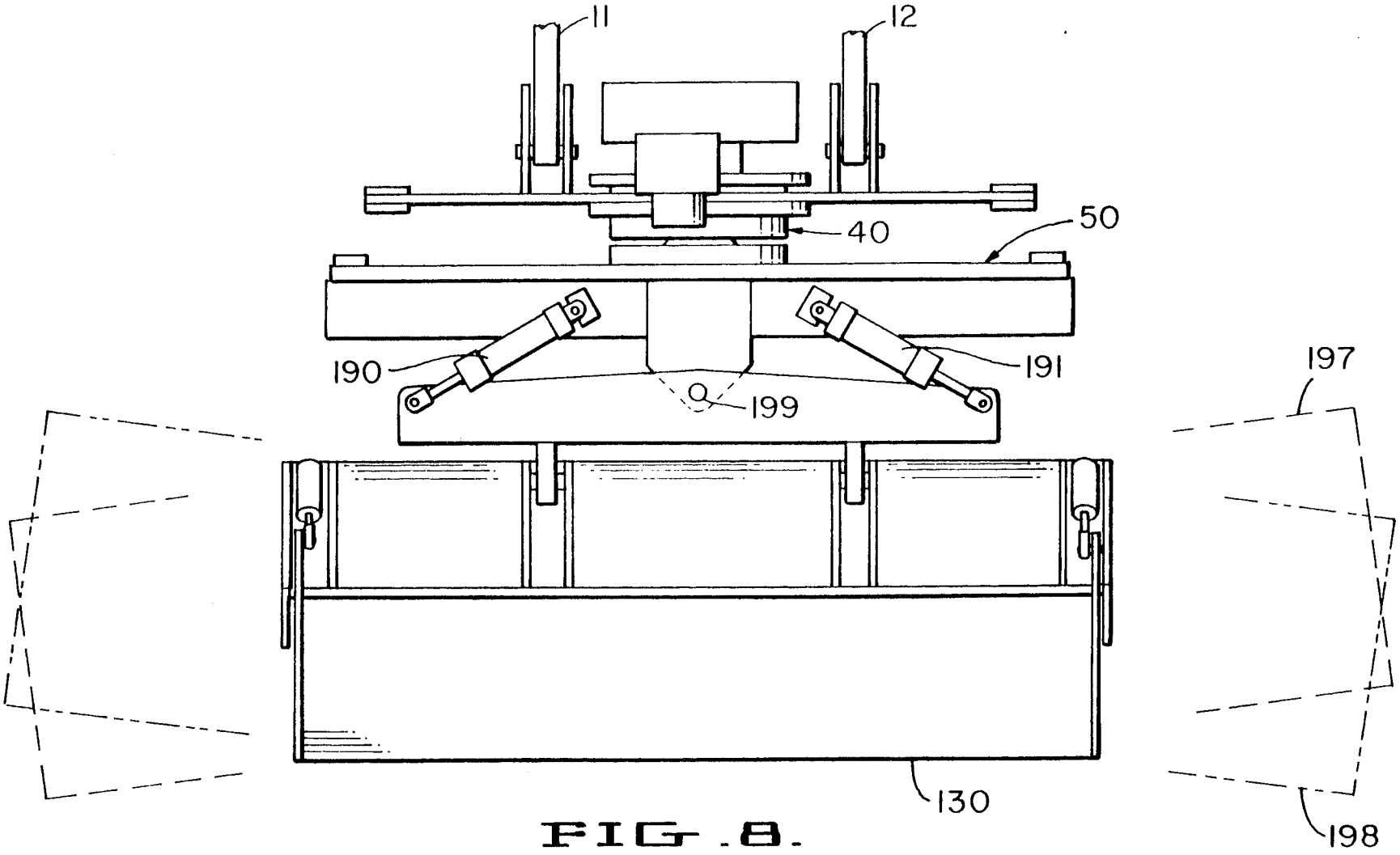
FIG. 8 is a top elevational view of an alternate embodiment of the invention.

FIG. 8 shows an alternate embodiment of the invention wherein the bucket 130 is pivotally mounted about pivot 199 so that the bucket 130 may be skewed through the positions shown in phantom as 197 and 198. To accomplish the skew motion of the blade, a pair of cylinders 190 and 191 is provided which are under direct control of the operator. The rotary drive means 40 and sliding drive means 50 are the same as shown in FIG. 6.

Figure 7:
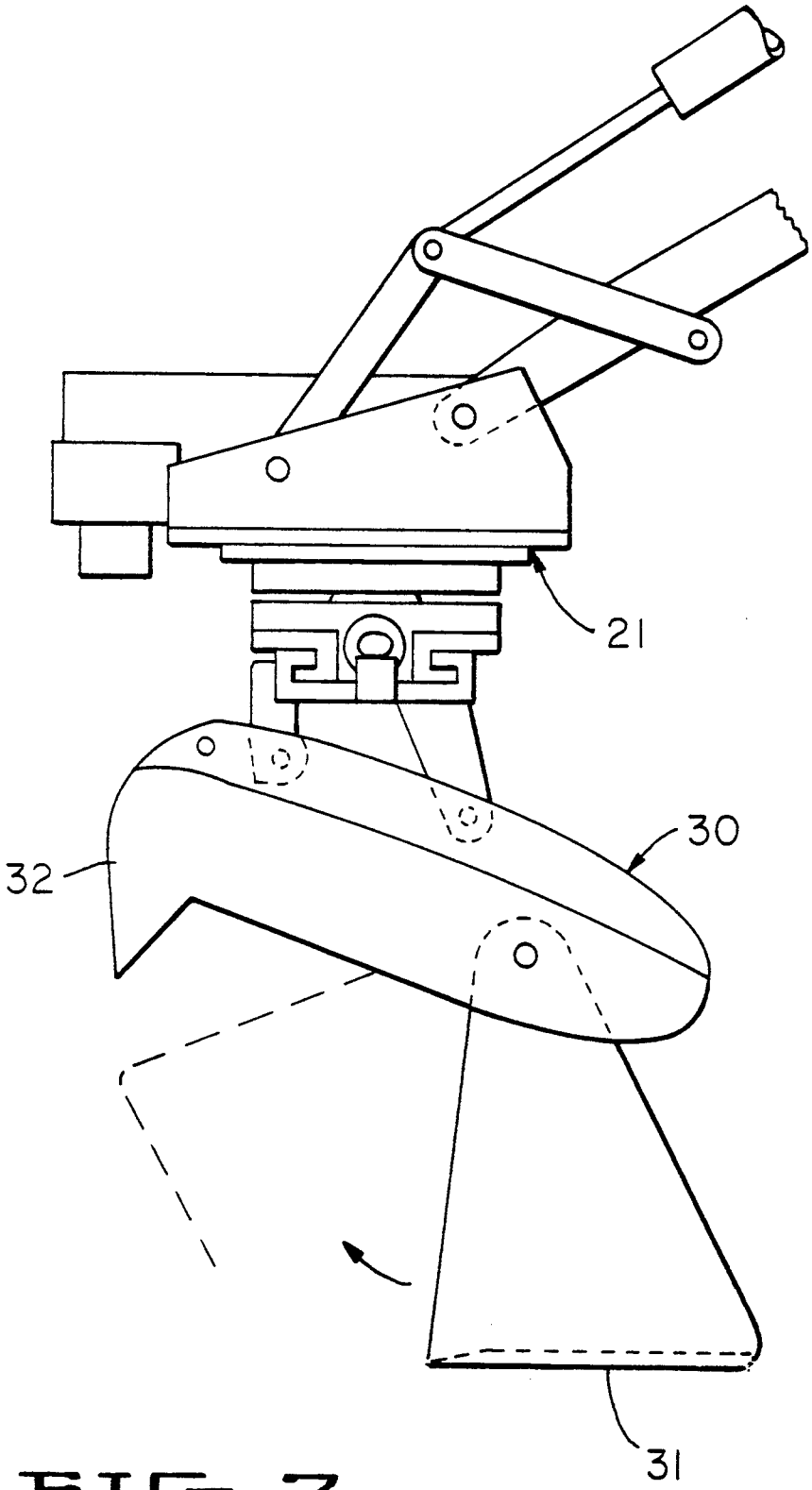
FIG. 7 is a side elevational view showing the opening and closing of the two-piece clam shell blade.

FIG. 7 shows that the mounting plate means 21 may be rotated to a horizontal position as shown in FIG. 7 with the two-piece clam shell bucket 30 directly beneath mounting plate 21. Jaws 31 and 32 may be used to grasp objects such as poles or timbers to be moved by closing jaws 31 and 32 to the position shown in phantom in FIG. 7.

I claim:

1. An articulating attachment for use in conjunction with a tractor, wherein said tractor is adapted to carry a working member, and wherein said articulating attachment facilitates rotary and sliding motion of said working member in transverse directions relative to the direction of travel of said tractor, said articulating attachment comprising:

mounting plate means for connecting said attachment to said tractor, rotary drive means carried by said mounting plate means for imparting rotary motion to said working member in directions transverse to the direction of travel of said tractor, and sliding drive means carried by said rotary drive means for imparting sliding motion to said working member in directions transverse to the direction of travel of said tractor, said sliding drive means being adapted to carry said working member.

2. The apparatus of claim 1 wherein said rotary drive means comprises:

a hydraulic motor carried by said mounting plate means, a hub driven by said hydraulic motor, said hub being carried by said mounting plate means, and said hub being free to rotate through more than 360° relative to said mounting plate means.

3. The apparatus of claim 2 wherein said sliding drive means comprises:

a first plate rigidly connected to said hub, a pair of generally U-shaped, elongated channels rigidly attached to said first plate, a second plate having elongated, L-shaped fingers adapted to slidably engage said generally U-shaped channels, and a double action hydraulic cylinder connected to said first and second plates to cause relative sliding motion between said plates.

4. A removable attachment for use in conjunction with a front loader, wherein said front loader is adapted to carry a bucket, wherein said removable attachment facilitates rotary and sliding motion of said bucket in directions transverse to the direction of travel of said front loader, comprising:

mounting plate means for removably connecting said attachment to said front loader, rotary drive means carried by said mounting plate means for imparting rotary motion to said bucket in directions transverse to the direction of travel of said front loader, and sliding drive means carried by said rotary drive means for imparting sliding motion to said bucket in directions transverse to the direction of travel of said front loader, said sliding drive means being adapted to removably carry said bucket.

5. The device of claim 4 wherein said bucket comprises:

a pair of jaws pivotally mounted on a common axis so that said jaws may open and close, and hydraulic drive means for opening and closing said jaws.

6. The device of claim 5 further comprising control means mounted in the cab of said front loader for allowing an operator to control the rotary, sliding, opening and closing motions of said bucket with one hand.

7. The device of claim 5 wherein each of said drive means is independent of the other drive means, so that said bucket may be rotated, slid, and opened or closed simultaneously.

8. The device of claim 4 wherein said rotary drive means is free to rotate through 360°.

9. The device of claim 8 wherein said sliding drive means can slide said bucket in either direction a distance of 50% of the width of said bucket.

* * * * *